US008801377B1

(12) United States Patent
Liang

(10) Patent No.: US 8,801,377 B1
(45) Date of Patent: Aug. 12, 2014

(54) TURBINE BLADE WITH TIP COOLING AND SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 546 days.

(21) Appl. No.: 13/217,602

(22) Filed: Aug. 25, 2011

(51) Int. Cl.
*F01D 5/18* (2006.01)

(52) U.S. Cl.
USPC ..... 416/97 R

(58) Field of Classification Search
USPC ..... 415/115; 416/90 R, 91, 97 R
See application file for complete search history.

(56) References Cited

U.S. PATENT DOCUMENTS

| | | | | |
|---|---|---|---|---|
| 4,390,320 | A * | 6/1983 | Eiswerth | 416/97 R |
| 5,503,527 | A * | 4/1996 | Lee et al. | 416/91 |
| 6,059,530 | A * | 5/2000 | Lee | 416/97 R |
| 6,422,821 | B1 * | 7/2002 | Lee et al. | 416/224 |
| 7,029,235 | B2 * | 4/2006 | Liang | 416/92 |
| 2002/0090301 | A1 * | 7/2002 | Lee et al. | 416/224 |
| 2009/0162200 | A1 * | 6/2009 | Tibbott et al. | 416/91 |
| 2011/0135496 | A1 * | 6/2011 | Botrel et al. | 416/96 R |

* cited by examiner

*Primary Examiner* — Edward Look
*Assistant Examiner* — Aaron R Eastman
(74) *Attorney, Agent, or Firm* — John Ryznic

(57) ABSTRACT

A turbine rotor blade with a squealer tip having an enclosed pocket channel formed below the squealer floor and having an inlet end opening adjacent to a leading edge region of the blade tip to receive cooler hot gas stream and direct the cooler gas toward the trailing edge region, and with film cooling holes along the aft section of the blade tip that discharge the cooler hot gas flow passing through the pocket channel onto the tip rail surface to produce both cooling and sealing. A similar pocket channel with film cooling holes can be used on the pressure and the suction sides of the blade tip.

13 Claims, 7 Drawing Sheets view A-A

TURBINE BLADE WITH TIP COOLING AND SEALING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with tip cooling and sealing for an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The performance of a highly loaded turbine is a strong function of the turbine blade tip clearance and leakage flow. A large running tip clearance with high leakage flow will induce high performance losses. Therefore, blade tip section sealing and leakage flow reduction and tip clearance gap should be addressed as a single problem. A prior art turbine blade includes a squealer tip rail that extends around a perimeter of the airfoil flush with the airfoil walls on the pressure and suction sides and forms an inner squealer pocket. The main purpose for using a squealer tip in the blade design is to reduce the blade tip leakage and to provide for rubbing capability of the blade tip with a stationary shroud surface in the turbine. FIG. 3 shows a turbine blade with a squealer tip with a secondary hot gas flow migration pattern over the blade tip section. The hot gas leakage flow flows across the blade tip section from the pressure side over the squealer pocket to the suction side. This hot gas migration from the blade lower span height is due to a pressure gradient formed between the pressure side and the suction side. Hot gas 25 flows in to the pocket, the secondary leakage flow 26 flows over the pocket, and a vortex flow 27 is formed next to the suction side tip rail. Smaller vortices are also formed that pass over the two rows of cooling air holes that open into the pocket and extend along the tip rails.

FIG. 4 shows a pressure distribution along the blade periphery at the tip location. A pressure level on the pressure side (P/S) is higher than on the suction side (S/S) of the blade.

The highest pressure is found at the blade leading edge. A pressure differential 33 is formed between the two sides of the blade and varies along the chordwise length of the blade.

FIG. 5 shows a temperature profile of the hot gas flow relative to the blade. A temperature level at the blade tip section is lower than a temperature level at the blade lower span or root. The highest gas flow temperature 34 is located at a mid-chord region where the hot gas flows over the blade tip. Because of this, the hot gas flow at the blade tip section can be used for cooling at the blade aft section.

BRIEF SUMMARY OF THE INVENTION

A turbine rotor blade with a tip section that includes two squealer blade tip flow channels that extend from an inlet end adjacent to the leading edge of the blade to the trailing edge. Rows of cooling holes connected the two flow channels to the pressure side and suction side walls of the blade tip to discharge the incoming hot gas flow that passes through the two tip flow channels. Trenches are formed on the crowns of the two tip rails and are each connected to the tip flow channel through cooling air holes and discharge some of the incoming hot gas flow toward a shroud to form a reduced effective leakage flow area for the blade tip.

DETAILED DESCRIPTION OF THE INVENTION

Figure 1:
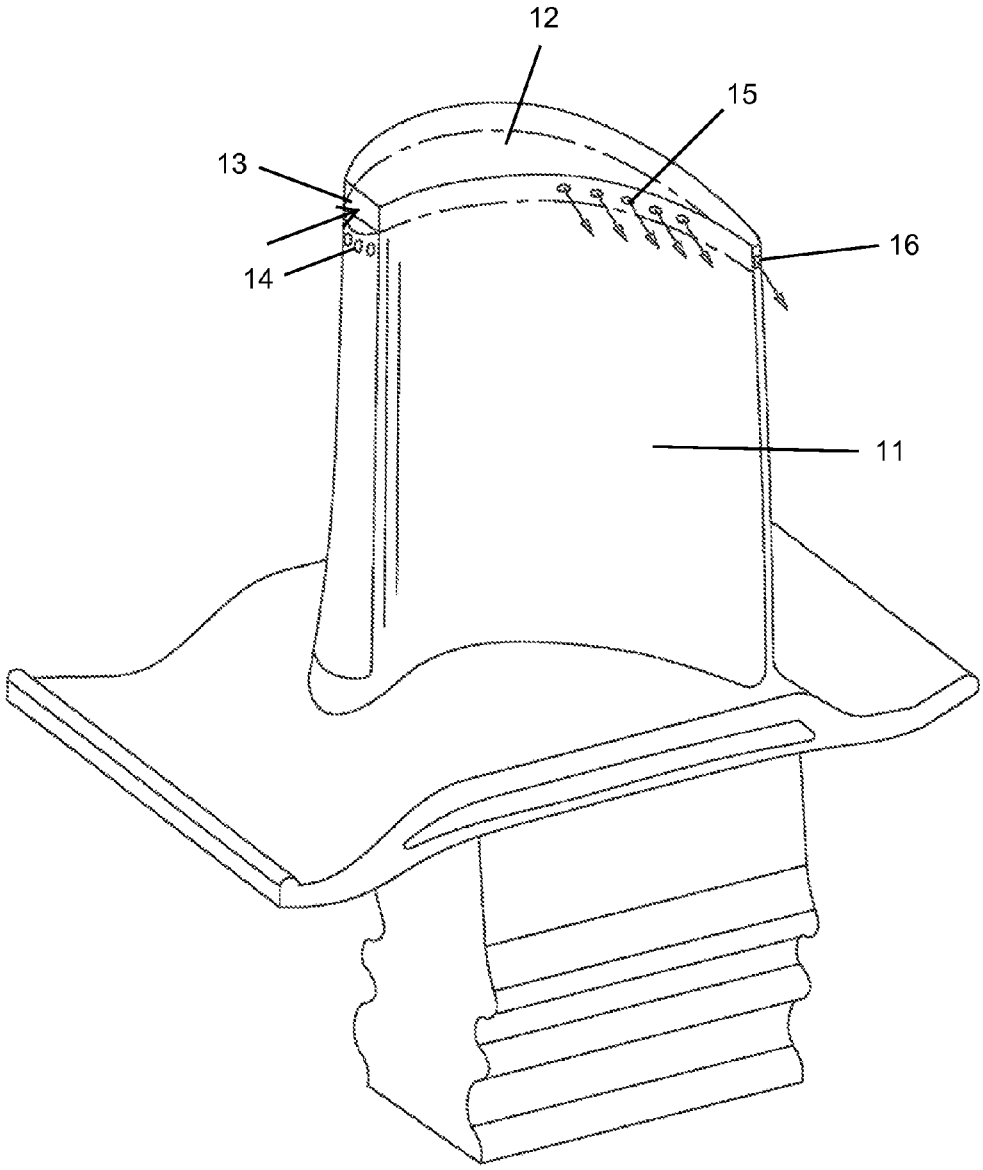
FIG. 1 shows an isometric view of a turbine rotor blade of the present invention with a passive cooled tip section design.
Figure 2:
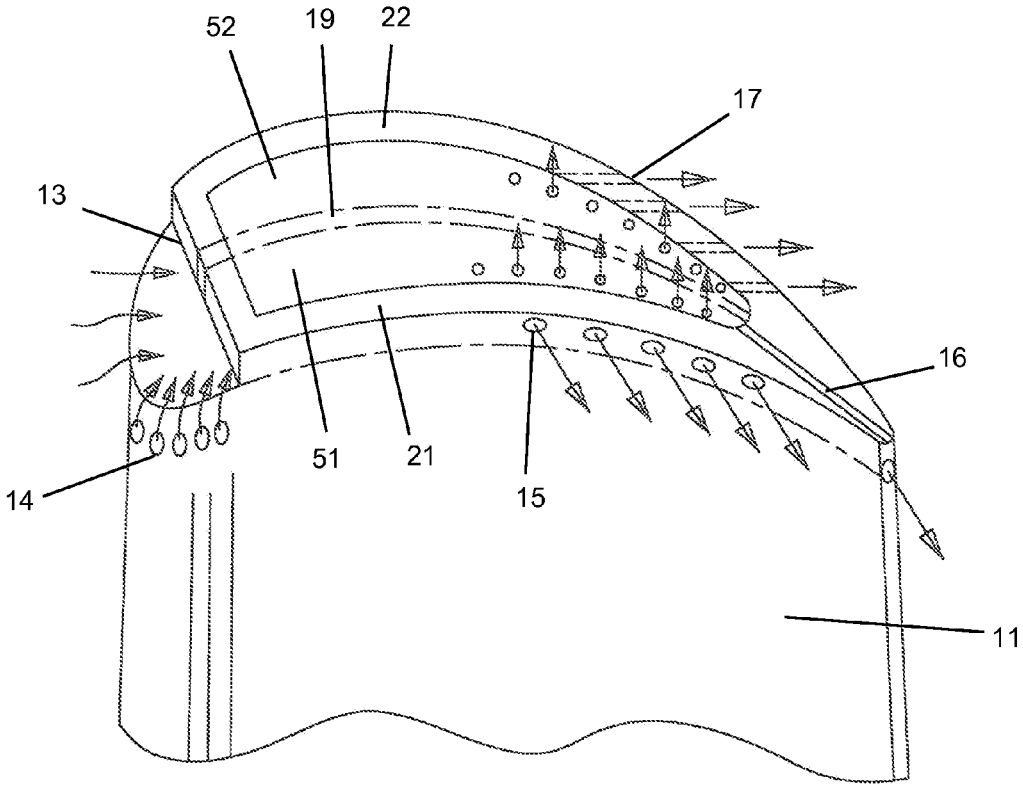
FIG. 2 shows a detailed view of the blade tip section for the FIG. 1 blade.
Figure 3:
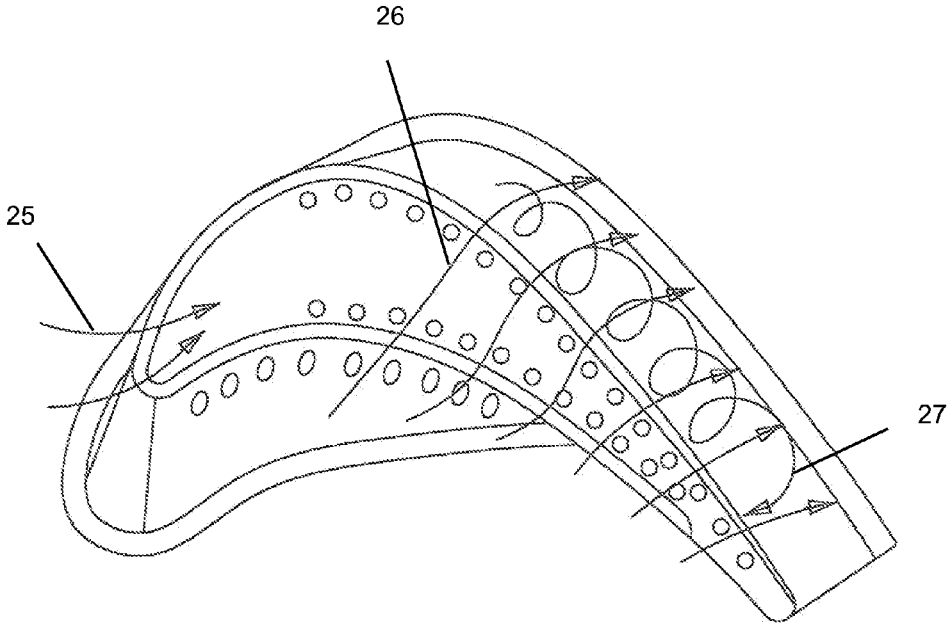
FIG. 3 shows a top view of a blade with a squealer pocket and the secondary flow pattern over the blade tip.
Figure 4:
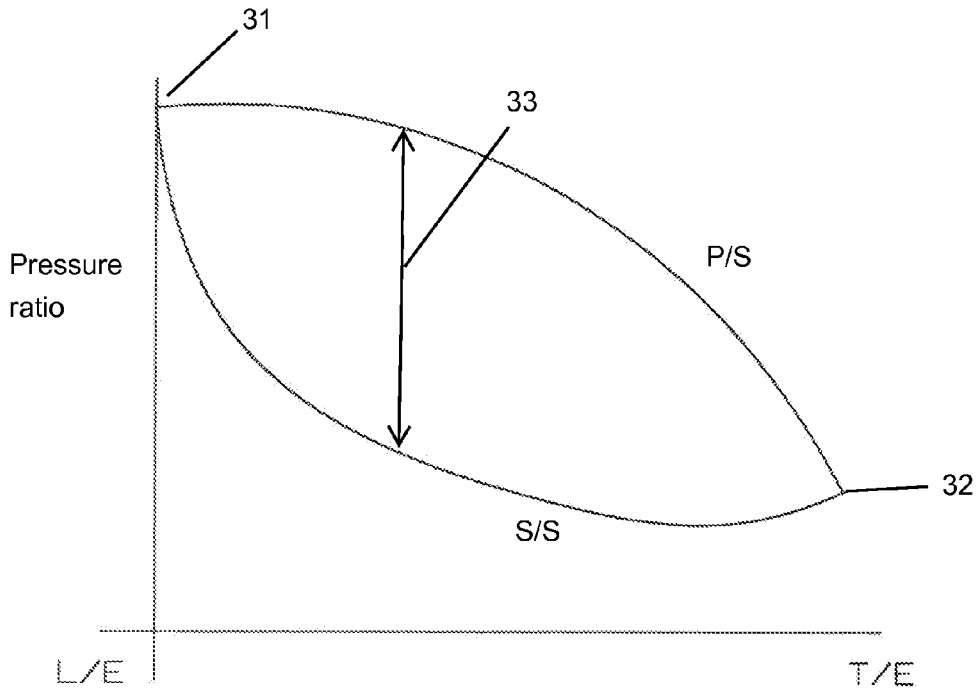
FIG. 4 shows a graph of the pressure distribution over a typical turbine rotor blade tip.
Figure 5:
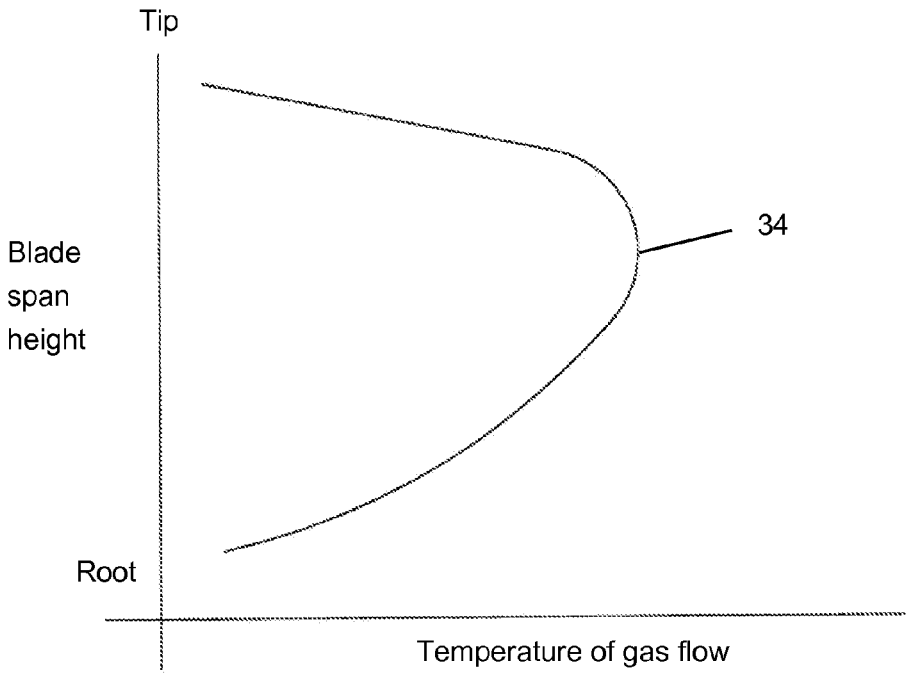
FIG. 5 shows a graph of the gas stream temperature distribution around the blade tip section of a typical turbine rotor blade.

A turbine blade with a passive cooling circuit of the present invention is shown in FIGS. 1 and 2. The blade uses hot gas from the main stream gas flow to provide cooling for the blade tip region of the blade. Other portions of the blade can be cooled using cooling air supplied from an external source such as the compressor of a gas turbine engine. As seen in FIG. 5, the hottest temperature of the main stream gas flow passes over the middle section of the blade tip with the cooler main stream gas flowing over the tip and the root of the blade. Of the main stream gas that flows over the tip, the hottest temperature gas flows over the middle section of the blade tip and toward the trailing edge of the blade tip. The main stream gas that flows over the blade tip in the leading edge region is cooler. Thus, the applicant makes use of this cooler main stream gas to provide cooling for the hotter sections of the blade tip region in which the film cooling holes are located as shown in FIGS. 2 and 6.

The blade (FIG. 1) includes an airfoil with a pressure side wall and a suction side wall, a blade tip 12 with a covered squealer pocket channel formed that extends from an opening 13 in the leading edge region to the trailing edge region. Film cooling holes 14 are located below a ledge formed on the leading edge tip. The ledge forms the inlet openings for two pocket channels 51 and 52 described below. A row of discharge holes 15 connects to the squealer pocket channel and opens onto the tip edge on the pressure side wall. A trailing edge discharge hole 16 opens onto the trailing edge of the blade and is also connected to the squealer pocket channel.

FIG. 2 shows a more detailed view of the blade tip section of the blade in FIG. 1. A partition rib 19 extends from the pocket inlet opening 13 toward the trailing edge and divides the covered squealer pocket channel into a pressure side channel 51 and a suction side channel 52. A row of cooling holes 15 connects to the pressure side pocket channel 51 and opens onto the pressure side wall underneath the tip rail edge to discharge the cooling air from the channel 51. A row of cooling holes 17 are also used on the suction side wall along the edge that connect to the suction side squealer pocket channel 52. P/S tip rail 21 and a S/S tip rail 22 both extend from the T/E and end at the ledge formed at the inlet opening 13. A T/E discharge hole 16 discharges cooling air from the pressure side pocket channel 51 because the pressure in the P/S pocket channel 51 is greater than the pressure in the S/S pocket channel 52. The FIG. 2 view shows the blade tip with the tip surface enclosing the two channels 51 and 52 that are separated by the partition rib 19. As seen in FIG. 2, rows of radial cooling holes 18 can be used on inner sides of the two tip rails to discharge some of the cooling air from the pocket channels onto the external top surface of the blade tip such as a squealer tip if used. Thus, the pocket channels could supply cooling air to both the film cooling holes opening onto the sides of the airfoil walls and to the radial holes discharging onto the outer or top side of the blade tip.

Figure 6:
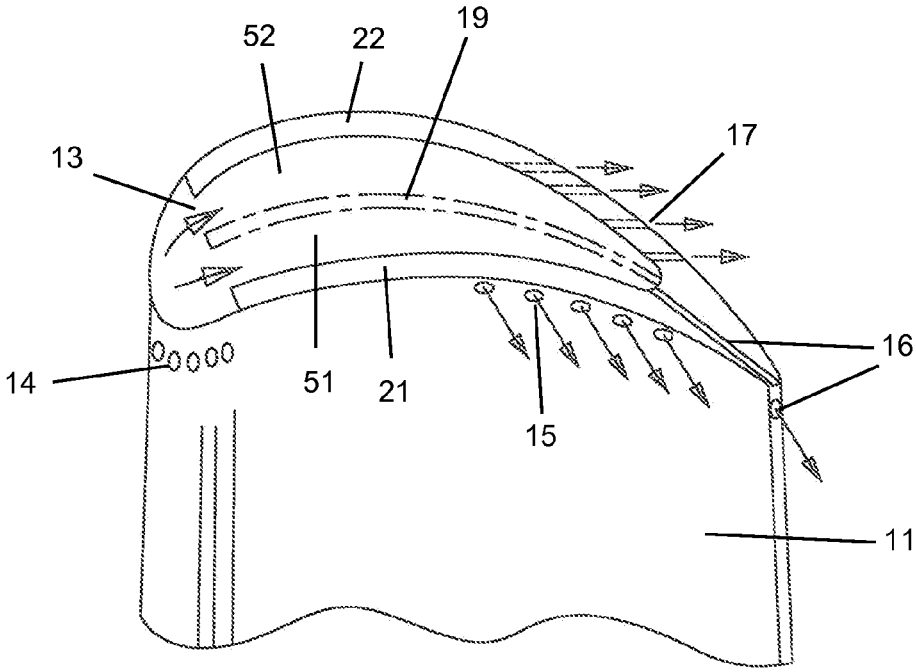
FIG. 6 shows a cross section cut through the blade tip section for the tip cooling circuit of the turbine rotor blade of the present invention.

FIG. 6 shows a view of the blade tip region of the blade in FIG. 2 with the pocket channels 51 and 52 exposed (without the blade tip top surface). The partition rib 19 separates the P/S pocket channel 51 from the S/S pocket channel 52. The T/E exit hole 16 is connected to the P/S pocket channel 51 because the S/S pocket channel 52 is at a lower pressure. Film cooling holes 14 on the leading edge region discharge cooling air from the internal cooling air circuit of the blade and merge with the hot gas stream that will then flow into the two pocket channels 51 and 52 to provide cooling for the hotter section of the blade tip region in which the film cooling holes 15 and 17 are located. Cooling holes 15 open onto the pressure side wall and discharge from the pressure side pocket channel 51, and cooling holes 17 open onto the suction side wall and discharge cooling air from the suction side pocket channel 52.

Figure 7:
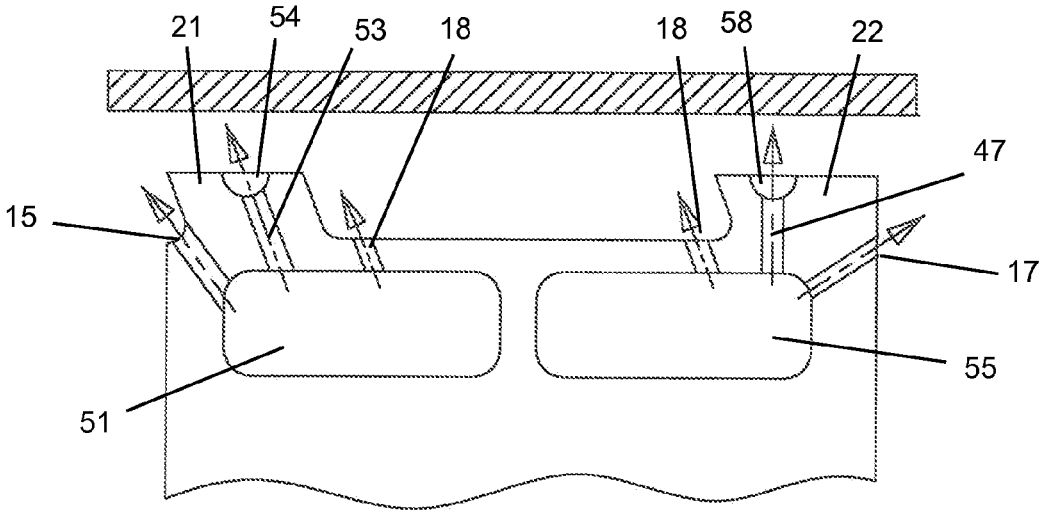
FIG. 7 shows a cut-away view of the blade in FIG. 6 through the line A-A.

FIG. 7 shows a cross section view of the squealer pocket channels 51 and 52 through line A-A shown in FIG. 6. The blade tip includes a P/S tip rail 21 and a S/S tip rail 22. Each tip rail includes an open and continuous groove or trench 54 and 58 that extends along the top surface of the tip rails. The two trenches 54 and 58 extend along the tip rails at about the same distances that the film cooling holes 15 and 17 are located because this is the hottest section of the blade tip region where a majority of the hot gas leakage flows over the blade tip. The two trenches 54 and 58 are each connected to the respective pocket channel 51 and 55 through rows of cooling air holes 53 and 47. additional cooling holes 18 can be used that connect to the respective pocket channel and discharge cooling air into the squealer pocket along the inner sides of the tip rails 21 and 22 in a direction toward the gaps that the leakage flows through.

Figure 8:
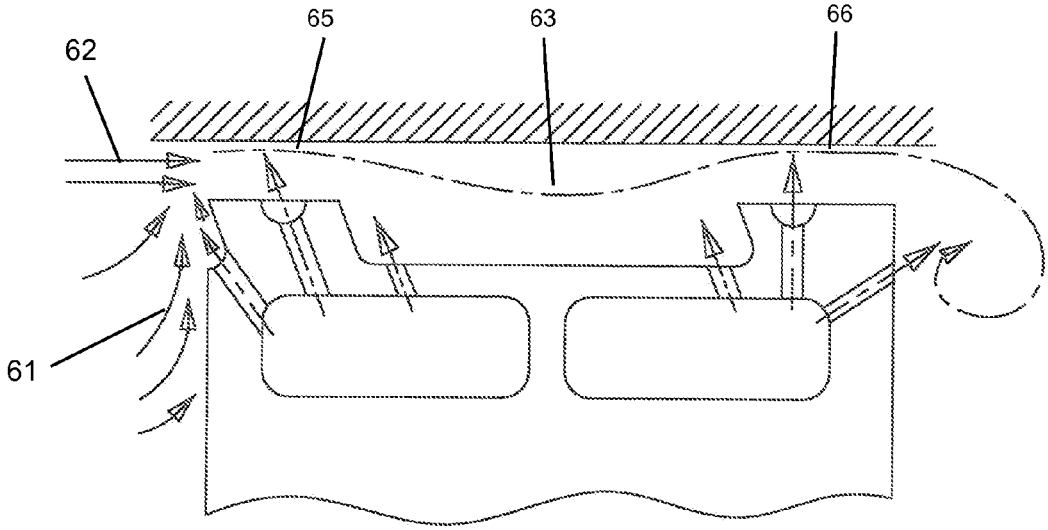
FIG. 8 shows a hot gas jet inter-action with leakage flow produced by the tip cooling circuit of the present invention.

FIG. 8 shows a flow diagram of the results of the discharge of the cooler air from the film cooling holes and the cooling air holes discharging into the trenches. The leakage flow path formed by the tip rails is decreased in the effective flow area due to the discharge of the cooling air from the trenches. Leakage flow 62 flows into the tip gaps formed over the P/S tip rail 65 and over the suction side tip rail 66 that are decreased in effective flow areas due to the discharge of the cooling air from the two trenches. The leakage flow flows into the squealer pocket 63 between the two tip rails and is then contracted again at 66 over the S/S tip rail. The secondary flow 61 migrates upward toward the tip region and merges with the film cooling air from the leading edge film cooling holes 14 and then flows through the gap over the P/S tip rail.

In operation, due to the pressure gradient across the airfoil from the pressure side to the suction side, the secondary flow near the pressure side surface migrates from a lower span upward across the blade tip end. The leading edge hot gas fluid in the blade pressure side tip flow channel is then discharged through a row of discharge holes next to the pressure side tip rail at a high exit jet velocity. This exit jet air forms an air curtain to block the incoming stream wise leakage flow across the blade tip gap formed between the BOAS and the squealer pocket. The injection of cooling air will decrease the vena contractor and reduce the effective flow area. The jet which is injected on top of the end tip will also block the oncoming leakage flow and further pinch the vena contractor. A result of injecting air flows from both tip rails, the leakage flow across the blade tip end is further reduced. The formation of this leakage flow resistance by the blade tip region shape and hot gas flow injection yields a very high resistance for the leakage flow path and reduces the blade leakage flow and reduces the effective leakage gap. A similar effect of leakage flow blockage on the pressure side tip rail also occurs on the suction side tip rail. The formation of the two tip rail cooling and leakage flow design on the blade tip region with hot gas flow ejection yields a very high resistance for the leakage flow path and thus reduces the blade leakage flow which will improve the blade tip section cooling.

I claim the following:

1. A turbine rotor blade for a gas turbine engine comprising:

an airfoil section having a pressure side wall and a suction side wall with a leading edge region and a trailing edge region;

a blade tip region with a pressure side tip rail and a suction side tip rail forming a squealer pocket;

a pressure side pocket channel and a suction side pocket channel separated by a partition rib;

the pressure side and suction side pocket channels extend from the leading edge region to the trailing edge region;

the pressure side and suction side pocket channels have inlets that open to a flow of a hot gas stream passing over the blade tip region;

a first row of film cooling holes connected to the pressure side pocket channel and opening onto the pressure side wall of the blade tip region; and, a second row of film cooling holes connected to the suction side pocket channel and opening onto the suction side wall of the blade tip region.

2. The turbine rotor blade of claim 1, and further comprising:

the pressure side and suction side pocket channels are enclosed channels covered by a floor of the squealer pocket.

3. The turbine rotor blade of claim 1, and further comprising:

the pressure side tip rail includes a first trench extending along a top side of the tip rail and connected to the pressure side pocket channel through a first row of cooling air holes; and, the suction side tip rail includes a second trench extending along a top side of the tip rail and connected to the suction side pocket channel through a second row of cooling air holes.

4. The turbine rotor blade of claim 1, and further comprising:

an exit hole opening onto the trailing edge of the tip region and connected to the pressure side pocket channel.

5. The turbine rotor blade of claim 1, and further comprising:

the inlets of the pocket channels are formed by a ledge in the leading edge region.

6. The turbine rotor blade of claim 5, and further comprising:

a row of film cooling holes opening onto the leading edge region of the blade just below the ledge.

7. The turbine rotor blade of claim 1, and further comprising:

a first row of cooling air holes connected to the pressure side pocket channel and opening into the squealer pocket adjacent to an inner side of the pressure side tip rail; and, a second row of cooling air holes connected to the suction side pocket channel and opening into the squealer pocket adjacent to an inner side of the suction side tip rail.

8. A turbine rotor blade for a gas turbine engine comprising:

an airfoil section having a pressure side wall and a suction side wall with a leading edge region and a trailing edge region;

a blade tip region with a pressure side tip rail and a suction side tip rail forming a squealer pocket;

an enclosed pocket channel having an inlet opening adjacent to a leading edge region of the blade tip and extending toward the trailing edge region of the blade tip; and, a row of film cooling holes opening onto a side wall of the blade just below the tip rail edge and connected to the enclosed pocket channel and directed to discharge cooling air toward the tip rail.

9. The turbine rotor blade of claim 8, and further comprising:

an exit hole opening onto the trailing edge and connected to the pocket channel.

10. The turbine rotor blade of claim 8, and further comprising:

the row of film cooling holes extends mostly in an aft half of the blade tip.

11. The turbine rotor blade of claim 8, and further comprising:

a row of cooling air holes opening into the squealer pocket adjacent to an inner side of one of the tip rails and connected to the pocket channel.

12. The turbine rotor blade of claim 8, and further comprising:

the inlet of the pocket channel is formed by a ledge in the leading edge region.

13. The turbine rotor blade of claim 12, and further comprising:

a row of film cooling holes opening onto the leading edge region of the blade just below the ledge.

* * * * *